US006196409B1

(12) United States Patent
Lake et al.

(10) Patent No.: US 6,196,409 B1
(45) **Date of Patent: *Mar. 6, 2001**

(54) VENTING MEANS

(75) Inventors: Kirk Wallace Lake, Sterrebeek; Neil John Rogers, Brussels; Marcel Vandebroek, Grimbergen; Bruno Van den Branden, Eppegem, all of (BE)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/981,370

(22) PCT Filed: Jul. 3, 1996

(86) PCT No.: PCT/US96/11275

§ 371 Date: Dec. 22, 1997

§ 102(e) Date: Dec. 22, 1997

(87) PCT Pub. No.: WO97/02191

PCT Pub. Date: Jan. 23, 1997

(30) Foreign Application Priority Data

Jul. 5, 1995 (EP) ..... 95870081

(51) Int. Cl.[7] ..... B65D 51/16

(52) U.S. Cl. ..... 220/371; 215/261; 215/308; 215/902; 220/373; 220/745; 220/DIG. 27

(58) Field of Search ..... 215/248, 261, 215/902, 307, 308, 310; 220/203.05, 371, 373, 745, DIG. 27, 367, 1, 368, 369, 370

(56) References Cited

U.S. PATENT DOCUMENTS

| | | | | |
|---|---|---|---|---|
| 3,071,276 | | 1/1963 | Pellett et al. | 215/56 |
| 4,315,579 | | 2/1982 | Martin, Jr. | 220/371 |
| 4,396,583 | | 8/1983 | LeBoeuf | 422/301 |
| 4,637,919 | | 1/1987 | Ryder et al. | 422/300 |
| 4,765,499 | | 8/1988 | von Reis et al. | 215/261 |
| 5,047,347 | * | 9/1991 | Cline | 220/371 |
| 5,395,006 | | 3/1995 | Verma | 220/371 |
| 5,595,711 | * | 1/1997 | Wilson et al. | 220/369 |
| 5,637,919 | * | 6/1997 | Ryder et al. | 220/371 |
| 5,766,660 | * | 6/1998 | Lee | 220/371 |

* cited by examiner

*Primary Examiner*—Stephen P. Garbe
(74) *Attorney, Agent, or Firm*—James C. Vago; Jack L. Oney, Jr.

(57) ABSTRACT

The present invention relates to a container, or a cap for a container for viscous liquid products. The container or the cap comprises a venting element. The venting element allows passage of gases between the interior and the exterior of the container when the pressure inside the container differs from the external ambient pressure. The container or cap further includes a control feature which controls the phase separation of the product splashed onto the membrane.

10 Claims, 4 Drawing Sheets

VENTING MEANS

FIELD OF THE INVENTION

The present invention relates to a container, or a cap for a container, which comprises a venting means. This container or cap further comprises a means which avoids a substantial decrease of the venting capacity of said venting means.

BACKGROUND OF THE INVENTION

The problem of container deformation in response to pressure differences existing between the inside of a closed container and the ambient pressure is well known in the packaging industry. Such container deformation may be non-recoverable for certain container materials, like some plastics or metals. Thin-walled, partially flexible containers are particularly sensitive to the problem.

There are a number of possible factors which may lead to the existence of the pressure differences between the interior and the exterior of the container mentioned above. The content of the container may, for example, be chemically unstable or may be subject to reaction with gases which may exist in the head space of the container, or alternatively, in certain specific circumstances, may react with the container material itself. Any chemical reactions involving the liquid contents may lead to either production of gases, and hence to overpressure in the container, or to the absorption of any head space gases thereby causing underpressure in the container.

Pressure differences between the pressure inside the container and the ambient atmospheric pressure may also occur when the temperature during the filling and sealing of the container is significantly different from external temperature during shipment, transportation and storage. Another possibility of a pressure difference may be caused by a different ambient pressure at the filling of the container from another ambient pressure at a different geographical location.

The prior art has proposed several solutions using valve systems which avoid pressure differences between the interior and the exterior of the container. Proposed solutions also relate to various venting caps which allow pressure generated inside the container to be released by escape of gas. For example, FR-A-2 259 026, U.S. Pat. No. 4,136,796 and DE-A-2 509 258 disclose self-venting closures comprising a gas-permeable membrane covering an orifice to the exterior. Said membranes are made of a material which is impermeable to liquids, but permeable to gases. Therefore, containers may comprise apertures to release gas to the exterior without losing their leak-tightness. Another example is EP-A-593 840 which discloses containers for containing liquids which generate pressure, said container being made of a thermoplastic material comprising a network of micro-channels. This network of microchannels is permeable to gases, but not to liquids.

We found that should liquid product contact these membranes, or the extremity of micro-channels, said membranes may lose at least part of their gas-permeability. Indeed, liquid products which are viscous or which have some affinity for these membranes may not drain away from said membrane back into the container. In this manner, it may happen that the container loses venting capacity. This loss of venting capacity results in a pressure difference between the exterior and the inside of said container which may deform said container. The contact between said product and said membrane may be caused by splashes of said product onto said membrane as the filled container is agitated during shipment and transportation of the container. We found that the amount of splashes normally occurring during shipment and transportation are sufficient to completely interrupt the venting capacity of said container. Another means by which product may contact with the membrane is during an upside down storage of the container. We further found that other venting systems, like valves for example, may also suffer from a similar disadvantage.

We further found that an important parameter which influences the draining away of said product from said membrane is that the product which has contacted said membrane may undergo phase separation. Specifically, we found that for certain type of products draining may be improved when phase separation is enhanced. On the contrary, we further found that phase separation induced on other different products substantially reduces the draining away from said venting means, and consequently reduces venting capacity of said venting means. Therefore, phase separation of the splashed product through said membrane is an important parameter which determines the venting capacity of said venting means.

It is therefore an object of the present invention to provide a container (10) for a liquid product, or a cap (10) for such a container which allows venting of said product by a venting means (20), and allows control of the phase separation of said product which is in contact with said venting means.

SUMMARY OF THE INVENTION

The present invention provides a container (10) for a liquid product, or a cap (10) for such a container, said container or cap enabling the venting of said product by a venting means (20). Said venting means allows the passage of gases between the interior and the exterior of said container when the pressure inside said container differs from the ambient pressure. Said venting means is permeable to gases, but impermeable to said product. Said container or cap contains a liquid product of the first group of liquid products, and said container or cap comprises a control means which limits the phase separation of said product contacted onto said membrane.

The present invention further provides another embodiment of a container (10) for a liquid product, or a cap (10) for such a container, said container or cap enabling the venting of said product by a venting means (20), which on the contrary contains a liquid product of the second group of liquid products, and said container or cap comprises a control means which enhances the phase separation of said product contacted onto said venting means.

DETAILED DESCRIPTION OF THE INVENTION

In the following, the drawings may refer to a portion of a container as well as a cap as well as any structure, like a lid, attached to said container. Indeed, the present invention may be part of a cap only, whereby said cap may be then engaged to any container filled with gasifying liquid products. A cap of the screw-on/in or snap-on/in type, or a flip-top, push-pull or turret cap closures may be engagement means between said cap and said container.

Figure 1A:
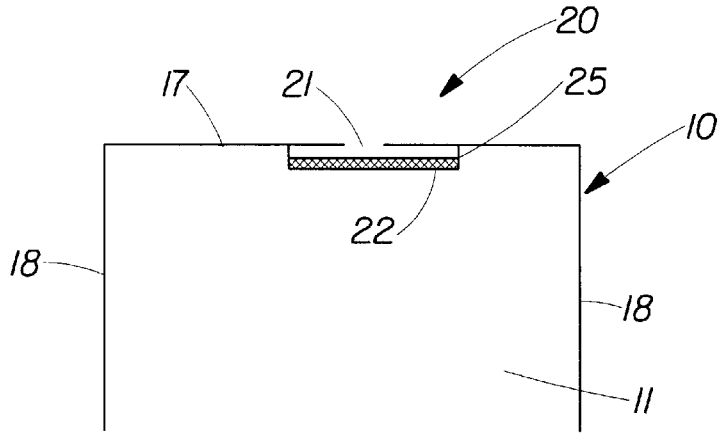
FIGS. 1*a,* 1*b* and 1*c* illustrate cross sectional side views of a container (partially shown) or of a cap comprising a venting means.

In the following, FIG. 1*a* will be described first as a container, then as a cap. In the first case, FIG. 1*a* shows a cross sectional side view of a container, the container (10) (only partially shown) comprises a hollow body (11). Said hollow body may comprise a top wall (17), a side wall (18) and a bottom wall (not shown in FIG. 1*a*). Said hollow body is able to contain any liquid products. Preferably, said hollow body is flexible to an extent that it may deform in response to pressure differences arising between the inside of said container and the ambient pressure. Pouches made of thin plastic material, for example, are also encompassed by the present invention. Otherwise, suitable shapes of said container may include essentially cylindrical, tapered cylindrical, oval, square, rectangular or flat-oval.

In case FIG. 1*a* represents a cross sectional side view of a cap, the cap (10) comprises a top wall (17) and a side wall (18). Said cap can be engaged in a leak tight manner to the container described before. In another preferred embodiment of the present invention, said container or cap (10) may comprise a spout. Preferably, said container or cap is made of plastic, metal, paper, or combinations of these materials as layers, laminates or co-extrudates. The materials may be also recycled. Preferred materials for said hollow body include plastics such as polyethylene (high or low density), polyvinyl chloride, polyester, polyethylene terephthalate (=PET), extrudable PET, polypropylene, polycarbonate and nylon. These plastics may be used individually or be combined as co-extrudates, layers or laminates.

As another essential feature, said container or cap (10) comprises a venting means (20). Said venting means is able to equalize the pressure inside said container to the external atmospheric pressure. Consequently, said venting means is able to avoid overpressure as well as underpressure inside said container. Indeed, said venting means allows the escape of gases released from the contained product from the inside to the outside of said container, or vice versa. Said venting means is located in the upper portion of said container above the level of said contained product, when said container is in its upright position. Indeed, the gases causing the overpressure or underpressure accumulate in the upper region of the container. Therefore, the passage of gases to the exterior or interior is facilitated.

Preferably, said venting means comprises at least an orifice (21) and a membrane (22). Said orifice connects the interior of said container with the exterior. Specifically, said orifice (21) allows the passage of gases from the interior to the exterior of said container, or vice versa, such that pressure inside said container is either maintained identical to the external atmospheric pressure or at a pressure at least below the pressure at which significant bottle deformation occurs. Said orifice may be located on said top wall or said side wall. As another preferred option, said orifice is part of a separate part of said hollow body (11) of said container, whereby said part can be attached onto said hollow body. The dimension of said orifice should be suitable for said passage of gases.

Said membrane (22) covers said orifice and is located between the content of said hollow body (11) and said orifice (21) in the interior or exterior of said hollow body (11). Said membrane is impermeable to liquids, but permeable to gases. Therefore, said membrane is able to provide a liquid impermeable barrier, while allowing gas venting. Preferably, said membrane may be liquid impermeable up to pressures differences of 1 bar between the inside and the outside of said hollow body, preferably up to pressures differences of 500 mbar. Said membrane may be a planar surface, at least when viewed macroscopically. Said membrane may also comprise a network of microchannels which is permeable to gases, but not to liquids, as described in EP-A-593 840. Said membrane may be corrugated macroscopically, like a zig-zagged surface, in which case said membrane is defined by several planes of different inclination with respect to the horizontal direction, connected to each other.

Preferably, said membrane (22) is any material capable of being formed into a thin layer which may be used to cover said orifice (21). Said membrane must be permeable to gas flow, also in response to small pressure differences. Preferably, said membrane should allow gas flow with pressure differences as low as 50 mbar, more preferably as low as 5 mbar. The thickness of said membrane is a matter of choice, but preferably would be in the region of 0.2 mm to 2 mm. Said membrane can comprise essentially any material which may be formed into thin layers such as plastics, paper or metal having micropores. Preferred materials for said membrane include microporous plastic films. The size of the micropores of said membrane should be such so as to allow the passage of gases at low pressure differences and at the same time to provide a high level of liquid impermeability. Preferably, the micropores will be in the range of 0.1 $\mu$m to 5 $\mu$m, more preferably between 0.2 $\mu$m to 1 $\mu$m. Preferably, said membrane has a rounded shape. But other shapes, such as rectangular, triangular or else, may be also foreseen to adapt it in a container or cap and/or improve the aesthetics of the container or cap itself.

Preferred microporous plastic films for this application are:

- non-woven plastic films, especially the non-woven spun bonded polyethylene film material sold under the trade name TYVEK by the Du Pont Company, of which TYVEK, Style 10, which is fluorocarbon treated to achieve high fluid impermeability;
- an acrylic copolymer cast on a non-woven support (nylon or PET) with a fluoro-monomer post-treatment hydrophobicity, sold under the trade name, VERSAPOR, by the Gelman Sciences Company, 600, South Wagner Road, Ann Arbor, Mich. 48106, US.

The microporous film material of said membrane (22) may be treated to reduce its surface energy and therefore to improve the impermeability to liquids of said film material. The lowering of the surface energy of said film material is particularly necessary to improve its impermeability when said container (10) contains products comprising surfactant components. Preferably in this case, the specific surface energy of said film material should be lower than that of the surfactant-containing product to achieve a substantially complete impermeability to the product contents.

Fluorocarbon treatment, which involves fixation of a fluorocarbon material, on a micro scale, to the surface of the film material is a specific example of a treatment which provides such reduced surface energy. Indeed, the fluorination treatment reduces the susceptibility of the microporous film material of said membrane to wetting by the liquid product contents. However, when used to treat said microporous film material of said membrane according to the present invention, this fluorocarbon treatment should not compromise the gas permeability of said membrane. For example, a possible fluorocarbon material for use in the fluorocarbon treatment according to the present invention is sold under the trade name SCOTCHBAN, by the 3M Company.

Said membrane (22) may be applied and located inside or outside said hollow body (11) between the content and said orifice (21) in any way maintaining its liquid-impermeability and gas-permeability according to the present invention. The means of application may therefore include the use of adhesives, or heat-sealing of said membrane onto the area around said orifice or mechanical means such as clamping or hot-stamping, or insertion of said membrane during molding of said container. As said before, the application means employed should not significantly compromise the venting ability of the membrane. For this reason, it is preferred that any adhesive used is also permeable to gases, or does not fill up the pores of the membrane.

As described in co-pending European application No. 94870161.0, the membrane (22) may be also fitted in a housing. Housings whose dimensions are particularly compatible for use in a container or a cap according to the present invention are commercially available from GVS, Via Roma 50, 40069, Zola Predosa (BO), Italy. In a highly preferred embodiment, the manufacture of said housing and the fitting of said membrane (22) in said housing can be achieved by an "insert molding operation", where:

- a sheet of membrane is fed into an apparatus; the sheet of membrane is advantageously fed from a roll of membrane material;
- in said apparatus, at least one membrane is cut from said sheet and is placed into a mold wherein said housing will be formed;
- then, the housing is molded substantially around said membrane in a manner which secures said membrane in said housing. As "substantially around" it is meant herein that once completed, this step should generate a housing with its fitted membrane, where both surfaces of the membrane are accessible to air, but said membrane is tightly maintained in the housing.

Housings may also be manufactured by heat sealing, ultrasonic sealing or gluing said membrane (22) into said housing. Furthermore, housings may be manufactured by mechanically holding the membrane between two separate pieces whereby said pieces are clipped together.

We found that the venting performance of said venting means (20) may be substantially reduced when the contained liquid product contacts said membrane (22). As explained above, said membrane is the most exposed part of said venting means towards the contained product. The contacting between said product and said membrane inside a container may mainly occur through splashes during shipment and transportation with agitation of said container. As used herein "splashing" means a non-continuous and brief contact of a liquid substance upon a surface when said liquid is agitated within the container. The splashing of the contained liquid product occurs mainly during shipment and transportation, when the risk of agitation of said container is higher.

We found that these membranes may lose their gas-permeability when the contained liquid product contacts said membrane (22). Indeed, we found that liquid product or part of said product may not sufficiently drain away from said membrane. In this manner, said membrane or part thereof may be covered by the product, i.e. the venting performance of said membrane is reduced for any part of said membrane covered by the product which has not drained away. Consequently, the venting capacity of the container is reduced or effectively lost.

This is particularly the case for liquid products which are viscous, or which have some affinity for the membrane. We found that products having viscosities of at least 5 cps when measured using a Brookfield viscosity meter at 60 rpm, spindle 3 and 20° Celsius demonstrate poor drainage away from said membrane. Other examples are liquids exhibiting shear thinning, non-newtonian flow behaviour or liquids having a low surface energy (<30 dyne/cm$^2$). For example, liquids comprising surfactants exhibit typically a shear-thinning flow behaviour. As used herein, a "shear thinning" product is a product which presents a high viscosity when the shear rate is low, and vice versa its viscosity is low when the shear rate is high. A shear thinning product exhibits poor drainage away from said membrane. We believe that, due to the product flow characteristics observed during drainage, the shear rate of product directly adjacent to the membrane is low. Consequently, the final layer of product adjacent to the membrane exhibits an intrinsically high viscosity. Therefore, the drainage of the final layer of product away from the membrane is impeded.

The contacting between said contained liquid product and said membrane (22) occurs mainly during shipment and transportation of the container. Indeed, said liquid product splashes onto said membrane within said container when said container is agitated. We found that the amount of splashes normally occurring during shipment and transportation are sufficient to completely interrupt the venting capacity of said container. Another means by which product may contact with the membrane is during an upside down storage of the container. We further found that other venting systems, like valves for example, may also suffer from a similar disadvantage. Consequently, the present invention provides a container for a liquid product, or a cap for such a container which improves the drainage of said splashed product away from said membrane.

A possible way to remove the splashed product from the membrane is to scrape the surface of the membrane splashed by said product. We found that the venting capacity of said membrane recovered sufficiently to prevent significant bottle deformation once said splashed product was scraped from the surface of said membrane. The scraping of said surface may be achieved with a device having the form of a shovel, for example. Although this solution solves the problem of the present invention, it has two major disadvantages. Firstly, the scraping action has to be carried out either manually by the user, which is inappropriate, or by a mechanical moving device within the container, which may be complex and expensive. Secondly, the action of scraping said splashed product from said membrane may damage said membrane. Indeed, especially the impermeability of said membrane to liquids may be easily lost through scraping.

Figure 1B:
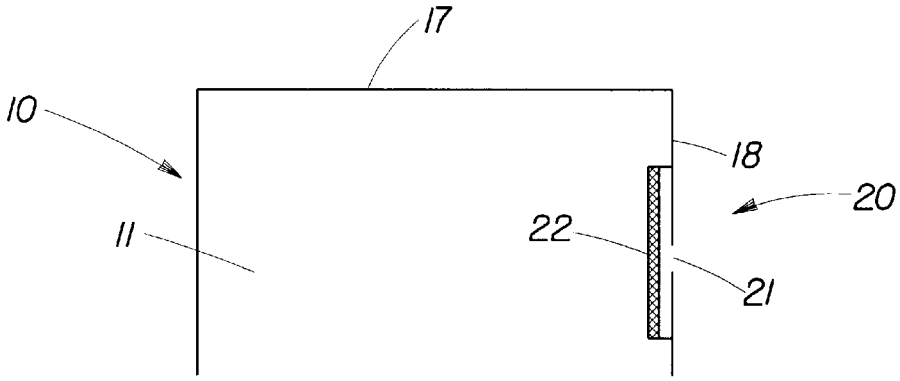
Figure 1C:
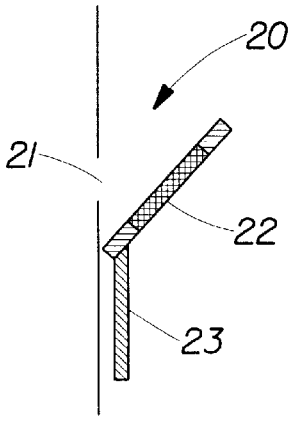

The co-pending European Patent Application No. 95104281.1 provides a container or a cap in which said splashed product is enabled or compelled to drain away from said membrane automatically without any scraping of said membrane. This means may comprise the positioning of said venting means in an inclined or vertical plane with respect to the supporting plane upon which said container stands in its upright position. This is shown, for example, in FIG. 1*b*, whereby said membrane (22) is vertical. Alternatively or in combination, said means comprises a draining means (23) extending from and connected to said venting means, as illustrated in FIG. 1*c*. Said draining means is preferably inclined or vertical with respect to the supporting plane upon which said container stands in its upright position. The co-pending European Patent Application mentioned before describes that this means improving the drainage of the product splashed onto said membrane ensures an effective venting of said venting means.

We now further found that the draining away of the splashed product from said membrane is influenced by the phase separation of said liquid product on said membrane (22). Indeed, we found that the phase separation of said product on said membrane can either limit or enhance the drainage of product away from said membrane, depending on the type of the liquid product. Indeed, we distinguished two different groups of liquid products. The distinguishing feature between these two groups is the change in viscosity after phase separation of said liquid product on said membrane. In the following, "liquid product" is a composition which comprises at least a liquid phase having a viscosity of at least 5 cps when measured using a Brookfield viscosity meter at 60 rpm, spindle 3 and 20° Celsius. "Phase separation" means that said liquid product separates into at least two distinct portions of matter, whereby said matters may be in liquid state, gaseous state, dry solid state or mixture thereof.

Figure 3:
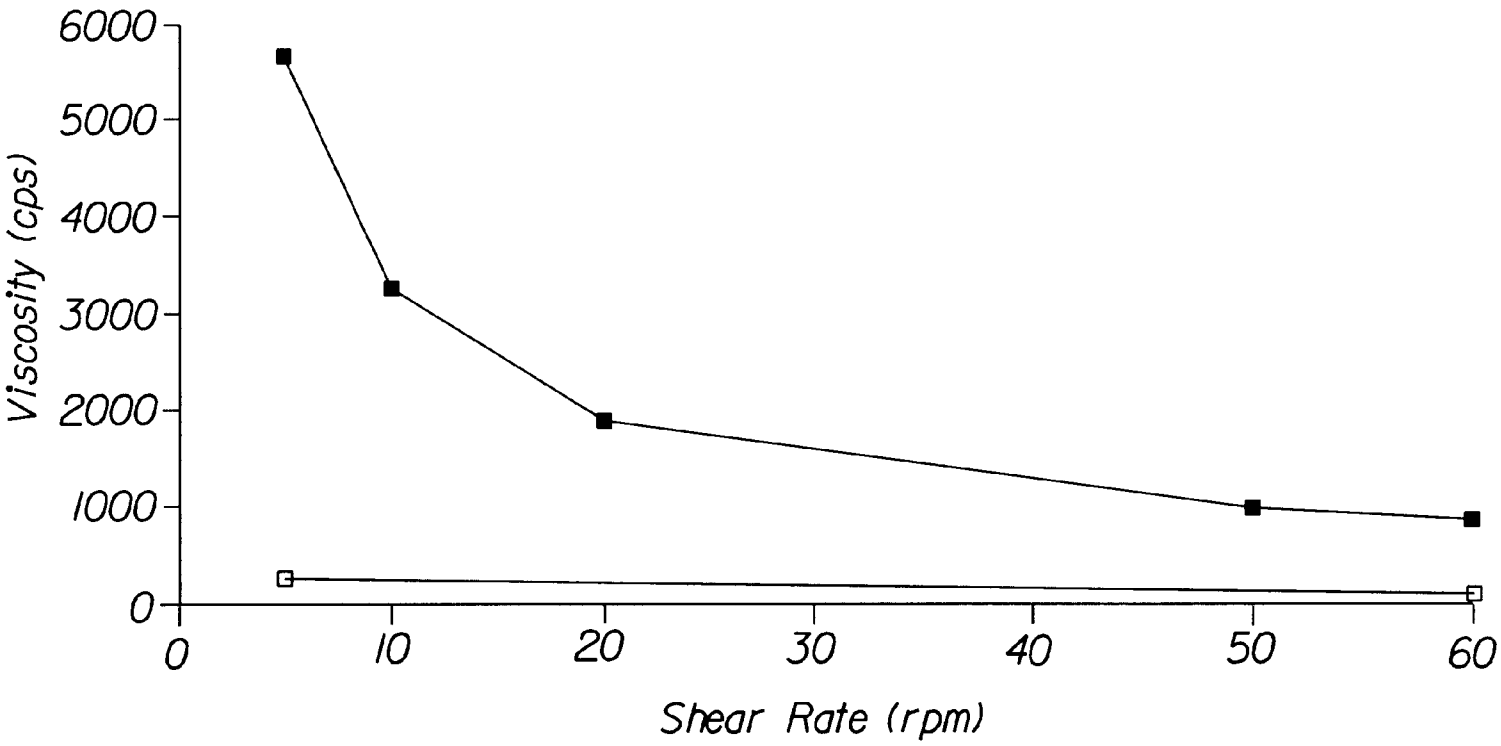
FIG. 3 is a diagram illustrating the viscosity as a function of the shear rate of a typical composition having a shear-thinning, non-newtonian flow behaviour compared to the viscosity of the phase separated portions of said composition.

The first group comprises liquid products which have at least one phase separated portion of matter having an increased viscosity with respect to the viscosity of the liquid product before its phase separation. On the contrary, the second group comprises liquid products which have all phase separated portions of matter of decreased viscosity with respect to the viscosity of the liquid product before its phase separation. We observed that the first group comprises liquid products having a substantially newtonian flow behaviour, compared to the second group which comprises liquid products having a substantially shear-thinning, non-newtonian flow behaviour. As used herein, a product having a newtonian flow behaviour" is a product of substantially constant viscosity over a wide range of shear rate. On the contrary, a product having having shear thinning, non-newtonian flow behaviour is shown, for example, in FIG. 3, whereby the curve connecting the filled squares is before phase separation, and the line connecting the empty squares is after phase separation.

Consequently, a phase separation of a liquid product of the said first group (hereinafter called "first liquid product") on said membrane (22) should be at least limited or completely avoided. Indeed, the portion which is phase separated from said first liquid product, has an increased viscosity in respect to said first liquid product. This means that this portion has even lower tendency to drain away from said membrane. Therefore, this portion partially covers or clogs said membrane reducing the venting capacity of said membrane. On the contrary, a phase separation of a liquid product of said second group (hereinafter called "second liquid product") on said membrane should be encouraged. Indeed, the portions which are phase separated from said second liquid product, have a lower viscosity in respect to said second liquid product. Therefore, these portions of said second liquid product drain more easily away from said from membrane avoiding to cover and to reduce the venting capacity of said membrane.

Examples of a first liquid products are non-emulsified liquid products, like the following composition used for the treatment of laundry in hand washing and/or in washing machine. In the following, "minors" are optional ingredients of the compositions or products such as stabilisers, chelating agents, radical scavengers, surfactants, bleach activators, builders, soil suspenders, dye transfer agents, solvents, brighteners, perfumes, foam suppressors and dyes.

EXAMPLE I

| INGREDIENTS | WEIGHT PERCENT |
|---|---|
| Hydrogen peroxide | 14.00 |
| Sodium hydroxide | 10.00 |
| 1,2 propane diol | 9.00 |
| C12–C14 alcohol ethoxylate, 7 EO | 11.00 |
| linear alkylbenzene sulphonate | 18.75 |
| fatty acid | 7.50 |
| water + minors | balance |

We found that the portion which is phase separated from said first liquid product of Example I gels onto said membrane, permanently masking said membrane if said gel portion is not mechanically removed from said membrane. In the following, "gel" refers to heavily viscous solutions. Therefore, said membrane loses at least partially its venting capacity.

Examples of second liquid products are shear-thinning, non-newtonian emulsions. These emulsions are described, for example, in the co-pending European patent application No. 92870188.7, in which a hydrophobic liquid ingredient is emulsified in the composition by using a specific non-ionic surfactant mixture. Following are other specific examples of second liquid products:

EXAMPLE II

| INGREDIENT | WEIGHT PERCENT |
|---|---|
| hydrogen peroxide | 7.5 |
| acetyl triethyl citrate | 7.0 |
| Dobanol ® 23-3 | 6.4 |
| Dobanol ® 45-7 | 8.6 |
| sodium alkyl sulphate | 2.0 |
| H2SO4 | up to pH 4 |
| water + minors | balance |

EXAMPLE III

| INGREDIENT | WEIGHT PERCENT |
|---|---|
| hydrogen peroxide | 6.0 |
| acetyl triethyl citrate | 3.5 |
| Neodol ® 45-7 | 8.1 |
| Lutensol ® T03 | 6.9 |
| sodium alkyl sulphate | 2.0 |
| H2SO4 | up to pH 4 |
| water + minors | balance |

In this case, the portions which are phase separated from a second liquid product do not gel onto said membrane. On the contrary, the separated portions have individual viscosities which are lower in comparison with the viscosity of initial second liquid product. Indeed, the viscosity of said second liquid product of Example II is typically between 1200 cps and 1800 cps measured using a Brookfield viscosity-meter at 50 rpm, spindle 3 at 20° C. However, the viscosities of the corresponding phase separated portions are typically smaller than 100 cps measured using the same test parameters as before. We further found that said phase separated portions exhibit less non-newtonian behaviour than the initial composition of Example II. Consequently, the separated phases are more able to drain away from said membrane, thus allowing venting through said membrane. The same effect has been observed with the second liquid product of Example III, whose viscosity before phase separation is typically between 1000 cps and 1400 cps measured using a Brookfield viscosity-meter at 50 rpm, spindle 3 at 20° C.

We found that the phase separation of the first and second liquid product at the membrane may be achieved by two distinct mechanisms: evaporation and/or hydrophobicity. These two mechanisms may be also combined with each other to achieve an enhanced effect. If certain components within said liquid product evaporate through said membrane (22) and said orifice (21), said liquid product phase separates. Indeed, without being bound by any theory, we believe that the porous material of said membrane connected to said orifice allows certain components to evaporate through said membrane, thus breaking down said liquid product in physically distinct portions of matter onto said membrane. The evaporation is enhanced by maximizing the open area of said membrane (22). Said open area of said membrane is the amount of area of said membrane exposed to the exterior of said container or cap. Thus, said open area may depend on the dimension and the number of orifices (21) which connect said membrane to the exterior of said container or cap. Therefore, a maximized open area increases the evaporation of certain components of said liquid product, and consequently enhances the phase separation of said liquid product.

Figures 2A, 2B, 2C:
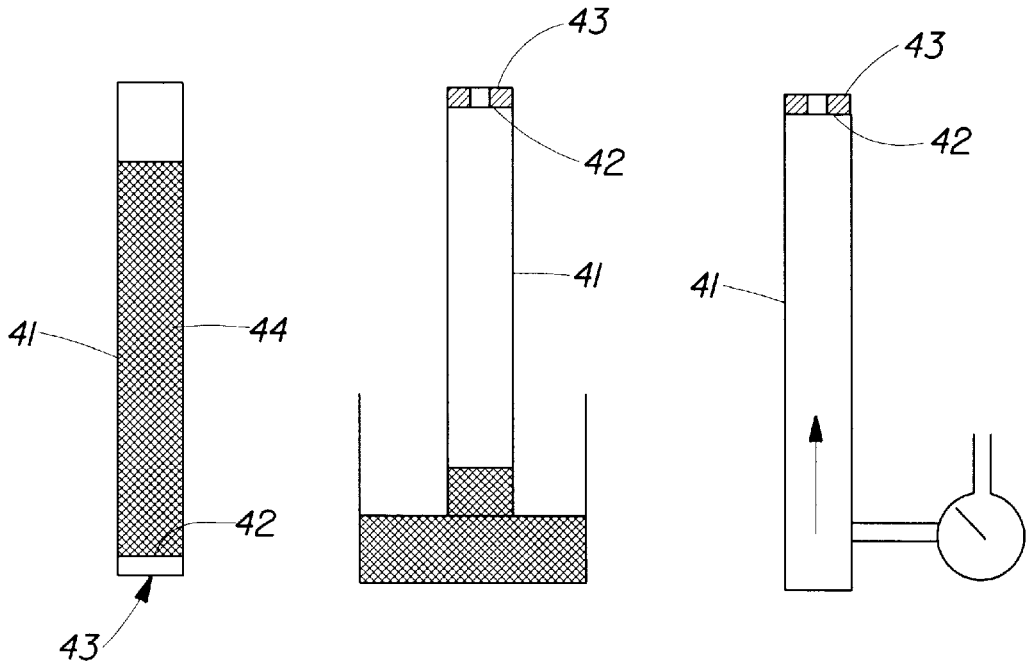
FIGS. 2*a* to 2*c* show the sequence of a test made to confirm the findings of the present invention.

This is demonstrated by the following tests results. As depicted in FIGS. 2*a* to 2*c*, a membrane of the type Versapor® V800R closes one open end of a cylindrical tube (41). Thus said membrane comprises an inner surface (42) directed towards the inside of said cylindrical tube, whereas the opposite outer surface (43) is completely exposed to the outside of said cylindrical tube being also the open area of said membrane. The open area of said outer surface (43) may be reduced by covering said outer surface with a polyethylene film comprising a pin hole. This membrane undergoes repeated splashes (FIG. 2*a*) with a liquid product (44), whereby said liquid product stays on said inner surface for 1 minute. Afterwards, said splashed liquid product is let to drain away from said membrane for 24 hours by turning said inner surface upside down. Finally, the venting pressure is measured after 24 hours drainage using a bubble point method. This whole process has been repeated three times.

The "bubble point method", mentioned above, comprises the following steps:

- placing a thin layer of water over the outer surface (43) of the membrane closing one open end of the cylindrical tube (41);
- increasing the pressure in said tube at a rate of 100 mbar per minute;
- recording the pressure at which air bubbles are seen to come through said membrane. This detected pressure defines said venting pressure above.

Figure 2D:
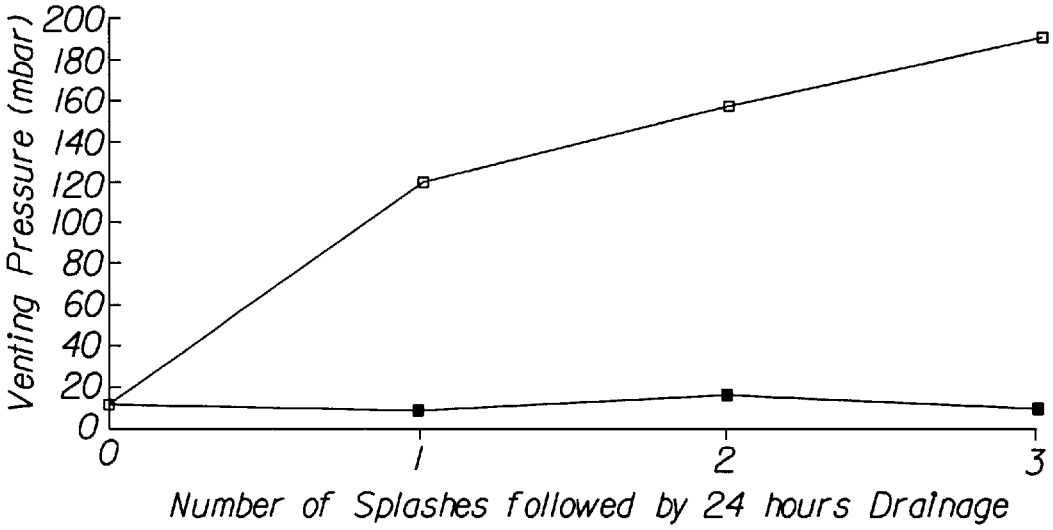
FIGS. 2*d,* 2*e,* and 2*f* are diagrams showing the results of the test with different levels of phase separation.

FIG. 2*d* represents the venting pressure after one, two and three splashes of a first liquid product as exemplified in Example I. When the outer surface (43) is not covered by said polyethylene film comprising a pin hole, said venting pressure increases with every splash (empty squares). This means that the venting capacity of said membrane is decreased when said first liquid product contacts said membrane. On the contrary, when the outer surface (43) of said membrane is covered by said polyethylene film, no substantial increase in venting pressure can be observed (filled squares). The venting capacity of this protected membrane is substantially held intact. This means that by limiting the open area of said outer surface (43) the venting capacity through said membrane is not jeopardized. Therefore, the drainage away of the first liquid product from said inner surface is encouraged when the evaporation through said membrane is limited. We found that this is true for any liquid product being within said group of first liquid products as defined above.

Figure 2E:
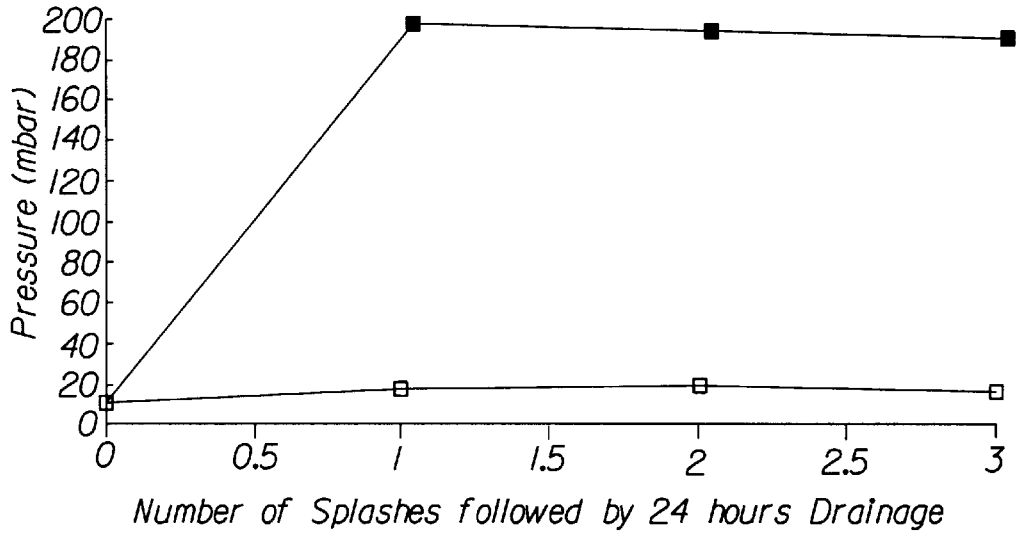

Instead, FIG. 2*e* represents the venting pressure after one, two and three splashes of a second liquid product as exemplified by the composition of Example II. When the outer surface (43) is entirely exposed to the outside of said tube (41), no substantial increase in venting pressure can be observed (empty squares). The venting capacity of this protected membrane is substantially held intact. On the contrary, when the outer surface (43) of said membrane is covered by said polyethylene film, said venting pressure increases with every splash (filled squares). This means that the venting capacity of said membrane is decreased when said second liquid product contacts said membrane. This means that by limiting the open area of said outer surface (43) the venting capacity through said membrane is substantially jeopardized. Therefore, the drainage away of the second liquid product from said inner surface of said membrane is encouraged when the evaporation through said membrane is maximized.

Figure 2F:
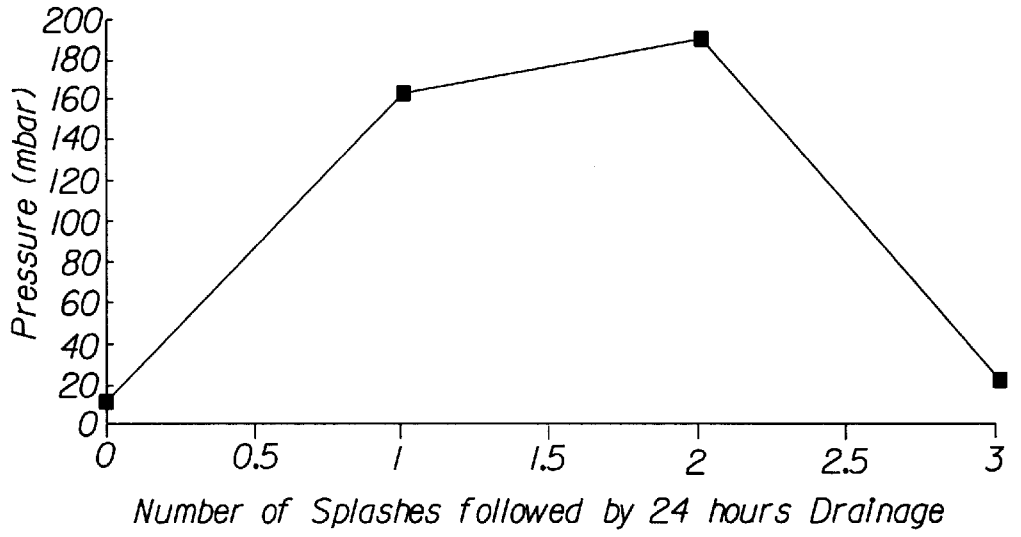

This is further shown in FIG. 2*f*. The first two splashes are made when said membrane is covered by said polyethylene film with hole. As before the venting pressure increases. But before the last splash, said polyethylene film is removed, and an immediate drop in venting pressure after a further splash is achieved. The same result has been observed with the composition of Example III, and this is true for any liquid product being within said group of second liquid products as defined above.

Thus, an essential feature of the present invention is a control means which controls the phase separation of said product on said membrane (22). This control means can either increase or decrease the phase separation on said membrane. As described above, when said container contains a first liquid product said control means should limit or impede phase separation of said first liquid product on said membrane by reducing the open area of said membrane. As a preferred option, said control means is provided by limiting the total size of said orifice (21). Indeed, the size of said orifice itself determines said open area. As an alternative, the size of said orifice, and therefore of said open area, may be reduced by further attaching a lid onto said orifice. Indeed, said lid, which at least partially covers said orifice, is able to reduce the open area of said membrane. Said lid may be a separate or integral part of said container or cap (10).

As another preferred option for said first liquid product, said control means is covering said membrane with a polyethylene film (25) comprising a pin hole at least on the surface of said membrane nearest to said orifice. The size of said pin hole should be such that phase separation of said first product on said membrane is limited or avoided. Preferably, the size of said open area of said membrane when said container contains liquid products of said first group is limited as a maximum to about 30% of the surface of said membrane nearest to said orifice, more preferably said open area is less than 20% of the surface of said membrane nearest to said orifice. We further found that another control means is the distance between said membrane and said orifice. Indeed, a greater distance between said membrane and said orifice reduces the phase separation of said first product on said membrane with respect to a membrane which has a smaller distance from said orifice. As a further control means, we found that a membrane not directly exposed to said orifice also exhibits a reduced phase separation of said first liquid product. For example, the overlapping walls over said membrane with a free passage may be a way to reduce the exposure of said membrane to said orifice.

On the contrary, when said container contains a second liquid product, said control means (30) should enhance the phase separation of said splashed product on said membrane. Therefore, a control means is exposing completely a surface of said membrane to the outside of said container. Preferably, the size of said orifice is maximized for said second liquid product to enlarge said open area. Therefore, at least a partial evaporation, and consequently a phase separation of said splashed product is enhanced on said membrane. As said before, this enhances the draining away of said splashed product from said membrane. The maximum size of said orifice is limited by the dimension of said container or cap. Preferably, the size of said open area when said container contains liquid products of said second group is at least 30% of the surface of said membrane nearest to said orifice, more preferably at least 50% of the surface of said membrane nearest to said orifice.

As another option for said second liquid product, is a control means (30) which exposes said membrane (22) to the air flow outside said container or cap. This may be achieved, for example, by having said membrane located above said top wall (17) of said container or cap. In this case, at least part of said membrane extends above said top wall through said orifice (21). To protect said membrane from being damaged during storing, transportation and handling said membrane may be covered by a cover. Said cover may then further comprise at least an orifice to get the air flow through the inside of said cover to said membrane. We found that this air flow further enhances the phase separation of said second liquid product on said membrane.

An alternative control means (30) for said second group liquids to control the phase separation on said membrane is a hydrophobic membrane. In the following, a "hydrophobic membrane" is a membrane (22) as described above having at least one surface directed towards the liquid product inside said container which is more hydrophobic than said liquid product. Said hydrophobic membrane may have all the external surfaces being hydrophobic. Indeed, we found that said hydrophobic membrane may encourage phase separation of said splashed liquid product onto said hydrophobic membrane. Without being bound by any theory, we believe that the different components which make up the product may have different surface tensions. Therefore, the inner surface (42) repels these different components differently, thus encouraging phase separation. This is especially true for the thin layer of liquid product which remains on the inner membrane surface after gross liquid product drainage has occurred. We found that the phase separation with a hydrophobic membrane has an important effect on the second liquid product group comprising oil-emulsions. Whereas hydrophobicity has substantially no effect on the first liquid products. Therefore, said hydrophobic membrane may be used in combination with the evaporation to encourage the draining away of said splashed product from said membrane.

What is claimed is:

1. A container, comprising:

a hollow body;

a vent in communication with said hollow body which allows passage of gases between the interior and the exterior of the container when the pressure inside the container differs from the ambient pressure, said vent having an orifice and a membrane with a first surface disposed adjacent said orifice and a second surface disposed opposite said first surface and exposed to said hollow body, said first surface having an open area corresponding to the area of said orifice;

a liquid comprising a plurality of components having at least one phase separated portion whose viscosity increases during phase separation relative to the viscosity of the liquid prior to phase separation; and wherein the ratio of said open area of said first surface to the entire surface area of said first surface is less than about 30% so as to limit phase separation of liquid contacting said membrane.

2. A container, comprising:

a hollow body for storing the liquid;

a vent in communication with said hollow body which allows passage of gases between the interior and the exterior of the container when the pressure inside the container differs from the ambient pressure, said vent having an orifice and a membrane with a first surface disposed adjacent said orifice and a second surface disposed opposite said first surface and exposed to said hollow body, said first surface having an open area corresponding to the area of said orifice;

a liquid comprising a plurality of components having at least one phase separated portion whose viscosity decreases during phase separation relative to the viscosity of the liquid prior to phase separation; and wherein the ratio of said open area of said first surface to the entire surface area of said first surface is greater than about 30% so as to enhance phase separation of liquid contacting said membrane.

3. A container, comprising:

a hollow body;

a vent in communication with said hollow body which allows passage of gases between the interior and the exterior of the container when the pressure inside the container differs from the ambient pressure, said vent having an orifice and a membrane having a first surface disposed adjacent said orifice and a second surface disposed opposite said first surface and exposed to said hollow body, said first surface having an open area corresponding to the area of said orifice;

a liquid comprising a plurality of components having at least one phase separated portion whose viscosity increases during phase separation relative to the viscosity of the liquid prior to phase separation; and a control means for limiting the phase separation of liquid contacting said membrane.

4. The container of claim 3, wherein said control means is the ratio of said open area of said first surface to the entire surface area of said first surface and wherein said ratio is less than about 30%.

5. The container of claim 4, wherein said ratio is less than about 20%.

6. The container of claim 3, wherein said membrane has a plurality of micropores.

7. A container, comprising:

a hollow body;

a vent in communication with said hollow body which allows passage of gases between the interior and the exterior of the container when the pressure inside the container differs from the ambient pressure, said vent having an orifice and a membrane having a first surface disposed adjacent said orifice and a second surface disposed opposite said first surface and exposed to said hollow body, said first surface having an open area corresponding to the area of said orifice;

a liquid comprising a plurality of components having at least one phase separated portion whose viscosity decreases during phase separation relative to the viscosity of the liquid prior to phase separation; and a control means for enhancing the phase separation of liquid contacting said membrane.

8. The container of claim 7, wherein said control means is the ratio of said open area of said surface to the entire surface area of said surface and wherein said ratio is greater than about 30%.

9. The container of claim 8, wherein said ratio is greater than about 50%.

10. The container of claim 7, wherein said membrane has a plurality of micropores.

* * * * *